US006616974B1

(12) United States Patent
Lorig et al.

(10) Patent No.: US 6,616,974 B1
(45) Date of Patent: Sep. 9, 2003

(54) FORM FOR PRINTING AND A METHOD OF MANUFACTURING SUCH FORM

(75) Inventors: Heinz Lorig, Bundesrepublik (DE); Jörg Richard, Bundesrepublik (DE); Klaus Langerbeins, Bundesrepublik (DE); Alfred Ernst Link, Bundesrepublik (DE)

(73) Assignee: Polywest Kunstofftechnik Saueressig & Partner GmbH & Co. KG, Ahaus (DE)

( * ) Notice: Subject to any disclaimer, the term of this patent is extended or adjusted under 35 U.S.C. 154(b) by 0 days.

(21) Appl. No.: 09/367,941

(22) PCT Filed: Nov. 26, 1998

(86) PCT No.: PCT/EP98/07647

§ 371 (c)(1),
(2), (4) Date: Nov. 8, 1999

(87) PCT Pub. No.: WO99/32275

PCT Pub. Date: Jul. 1, 1999

(30) Foreign Application Priority Data

Dec. 18, 1997 (DE) ..... 197 56 327

(51) Int. Cl.[7] ..... B05D 3/00; B05D 3/06; B05D 5/04; B41M 1/04

(52) U.S. Cl. ..... 427/271; 427/374.1; 427/387; 427/556; 101/483

(58) Field of Search ..... 427/554–556, 427/277, 355–356, 358, 372.2, 374.1, 374.4, 385.5, 387, 388.1; 428/446, 447, 450, 906; 492/16, 17, 18, 28, 30; 101/375, 395, 401.1, 483; 430/306, 945

(56) References Cited

U.S. PATENT DOCUMENTS

| | | | | | |
|---|---|---|---|---|---|
| 4,334,787 | A | * | 6/1982 | Kluth et al. | 222/319 |
| 4,339,472 | A | * | 7/1982 | Tachibana et al. | 427/277 |
| 4,360,566 | A | * | 11/1982 | Shimizu et al. | 118/60 |
| 4,368,240 | A | * | 1/1983 | Nauta et al. | 118/107 |
| 4,664,058 | A | * | 5/1987 | Schroeder et al. | 118/249 |
| 5,797,322 | A | * | 8/1998 | Lorig et al. | 101/153 |
| 5,798,202 | A | * | 8/1998 | Cushner et al. | 430/306 |
| 5,837,329 | A | * | 11/1998 | Kokufuda | 118/35 |

FOREIGN PATENT DOCUMENTS

| | | | | |
|---|---|---|---|---|
| EP | 0 374 951 A2 | * | 6/1990 | C08L/83/07 |
| EP | 0 671 253 A2 | * | 9/1995 | B29C/70/70 |

* cited by examiner

*Primary Examiner*—Shrive P. Beck
*Assistant Examiner*—William Phillip Fletcher, III
(74) *Attorney, Agent, or Firm*—Sonnenschein, Nath & Rosenthal LLP

(57) ABSTRACT

The invention relates to a form for the rotary machine printing, coating or imprinting of web-shaped materials and a method of producing the form wherein at a carrier having a cylindrical surface area an elastomer layer is attached which after curing at the outer circumference thereof is machined and engaged to result in a cylindrical shape. Furthermore the invention is characterized in that the elastomer layer is formed of a hot cure single-constituent or two-constituent silicone polymer.

27 Claims, 2 Drawing Sheets

FORM FOR PRINTING AND A METHOD OF MANUFACTURING SUCH FORM

FIELD OF THE INVENTION

The invention relates to a form for the rotary machine printing, coating or imprinting of web-shaped materials, wherein at a carrier having a cylindrical surface area, an elastomer layer is attached which, after curing, at the outer circumference thereof, is machined to give a cylindrical shape, and engraved. Furthermore, the invention relates to a method for manufacturing a form for the rotary machine printing, coating or imprinting of web-shaped material, wherein at a carrier having a cylindrical surface area an elastomer layer is attached which, after curing at the outer circumference thereof, is machined to give a cylindrical shape, and engraved.

BACKGROUND OF THE INVENTION

Forms of the kind mentioned before are used for different applications. In an embodiment as a printing form, e.g., for letterpress printing, in particular; for flexographic printing, the outer surface of the engraved elastomer layer forms the color transferring surface. For this reason, various requirements are imposed for the elastomer layer and the surface thereof. For example, it must have a sufficient resistance against solvents present in the printing paint, a good dynamic performance, and color transfer performance, and a small swelling under the influence of printing paints, and after the printing process it must be easily and simply cleaned from the printing paint. The requirements are similar when the form is used for coating processes, e.g., as a transfer roller for flatbed printing, in particular offset printing. The term "coating" is to be understood in particular for the transfer of printing paints in the printing processes, in particular for flexographic printing, as well as the transfer of, e.g., varnishes or glues onto web-shaped materials. Depending on the requirements, a transfer across the complete surface, and also a transfer only onto selected surface areas, is possible. When the form is used as an imprinting form, the elastomer layer in particular has to comprise a good dimension stability, and wear resistance even at the common temperatures of the material to be imprinted in imprinting processes, as well as a good separating performance in order to imprint web-shaped materials with a sufficient economy. Independent from the envisioned application of the form in any case, the elastomer layer must be well engraveable. The web-shaped materials to be printed with such a form, coated, or to be imprinted, as an example, may be paper or textile webs, metal or plastic foils or compound materials comprising different materials.

Hitherto, elastomer layers fulfilling all mentioned requirements on the form could only be produced by vulcanization of elastomer compounds onto temperature stable carriers at a high temperature. The temperatures required for the vulcanization, in practical operation at least 140° C., require the stock holding of appropriate devices, in particular autoclaves, for manufacturing the forms, wherein particularly large printing forms having a length up to several meters and a circumference up to about 2 m require complicated heating devices. Therein correspondingly high unit and energy costs are necessary for generating the forms. Additionally, the relatively long time for vulcanizing of 12 hours or more per form have a negative impact. As the carrier onto which the elastomer layer is applied also has to withstand the temperatures occurring during the vulcanization without damage, the selection of material for the carrier is considerably restricted, namely, to materials having a sufficient pressure and temperature stability. For practical reasons almost only metallic carriers may be used, whereas plastic carriers which would be preferred because of their lighter weight can hardly be used. Only premium glass fiber reinforced plastic materials are capable of coping with the high temperatures occurring during the vulcanization over the required time span. Hollow cylindrical light weight carriers may be made from these glass fiber reinforced plastic materials onto which the elastomer layer may be vulcanized, however, there is the disadvantage, that the possible variation in thickness of the carrier is very limited. Therefore, only relatively small repeat length areas may be covered in hollow cylindrical forms with a defined inner diameter for a certain-firm mandrel roller outer diameter. In practical experience, it therefore happens, that in factories using the forms, a very large number of different mandrel rollers have to be kept in stock. These mandrel rollers are expensive and require large warehouse space.

From DE 196 12 927 A1 a printing machine and an image generating process for a printing machine are known wherein the printing machine in a printing group comprises a seamless image cylinder which, by means of a direct image generating process within the printing group, is covered with a polymer to be dried. After the drying, the surface capacity of the polymer applied to the image cylinder is completely, or by areas, changed by means of selective laser radiation in order to change its affinity regarding a printing paint. The image cylinder may only be used in a wet or dry offset printing because the polymer layer is very thin (typically 2–10 $\mu$m) and therefore an engraving is impossible. For the specific application of the waterless offset printing, silicones are used as polymers, wherein in this case the feature is essential that they reject printing paints.

In an older non-published German Patent Application 197 25 749.2, owned by the assignee of the present application, a method for generating a seamless printing form for the rotative letter press printing, in particular for flexo-graphic printing, is described wherein at a carrier having a cylindrical surface area an elastomer layer is attached which after curing is engraveable, wherein for forming the elastomer layer a cold curing silicone polymer or silicone fluor polymer is used. Because of the use of cold curing materials for forming the elastomer layer, this method requires the smallest possible technical effort for its application, such that the generation of forms according to this method is relatively inexpensive. For applying this method, however, relatively long curing times of the elastomer layer must be tolerated, wherein this curing time in practical experience lasts for several hours. This high time effort for the curing of the elastomer layer leads to the fact that only a limited productivity may be attained with this method, or that very much warehouse space must be provided for receiving the forms for which the curing of the elastomer layer is not yet finalized.

SUMMARY OF THE INVENTION

It is the object of the present invention to provide a form of the kind mentioned before which is to be produced in a simple, and fast, and inexpensive way with the required features for a given case, and wherein for the carrier different materials, also light weight materials may be used. It is a further object to provide a method of the kind mentioned before wherein the manufacturing of a form for the rotary machine printing, coating or imprinting of web-shaped materials is possible, which requires no high effort in equipment during its application, and wherein the selection of materials required by the carrier offers a large variety. Therein also sleeve-shaped forms are to be produced with the method wherein a large repeat length area may be covered with a defined mandrel roller, i.e., wherein the thickness of the form may vary in relatively large ranges.

According to invention, the first part of the object is attained with a form of the aforementioned kind which is characterized in that the elastomer layer is formed of a hot cure single-constituent or two-constituent silicone polymer.

The object relating to the method according to the invention is attained in a method of the aforementioned kind which is characterized in that for forming the elastomer layer, a hot cure single-constituent or two-constituent silicone polymer is used.

The term "hot cure" is to be understood such that the temperatures occurring in curing the material and/or to be applied are between approximately 80 and 250° C.

It has been found that also the quoted hot curing materials for the manufacturing of an elastomer layer of a form for the rotary machine printing, coating or imprinting of web-shaped materials are suitable which fulfill all requirements brought forward. The essential advantage of the form and the process according to the invention, is that a very high quality of the elastomer layer is gained in a very short production time. Despite the use of hot curing materials, temperature based restriction in the selection of materials for the carrier are avoided to a high degree as the temperature required for the hot curing has to be applied only for a relatively short time. Therefore, materials may be used for the carrier which hitherto were excluded for this purpose. In particular, plastic materials come in mind which hitherto could not be used because of their lower heat resistance in this area of the manufacture of forms compared with metals. The use of plastic materials instead of metals for the carrier renders considerable reductions in weight which facilitates the transport and the handling of forms to a high degree. It is a further advantage that now the carriers may be produced with largely different material thicknesses when producing sleeve-shaped carriers, and for forms having a preset inner diameter of the carrier, very different repeat length may be covered. Thereby, for the user of the sleeve-shaped forms, the number of mandrel rollers to be kept in stock is reduced. At the same time, the possibility remains to use metallic carriers as the elastomer layer of the hot cure materials-cited sticks to a carrier of plastic material, as well as to a carrier of metal, after curing with a durability which is absolutely sufficient for practical operation.

The forms preferably are seamless forms; as an alternative the elastomer layer may be firstly generated in a flat shape, and then bent onto the carrier and, e.g., bonded.

When the material for forming the elastomer layer is used in the form of a single-constituent material, it may be handled relatively easy and its stock holding, processing and application onto the carrier requires only a relatively small technical effort. At the other side, shorter shelf lives generally have to be accepted with single-constituent materials.

As an alternative, the material can be used as a two-constituent material. Advantageously, hereby longer shelf lives are possible leading to a higher productivity and smaller production costs for the form. At the other side, the use of two-constituent material requires a somewhat higher technical effort for the processing and application, however, this is soon compensated when producing high numbers of forms.

It is preferably provided that the material for forming the elastomer layer is attached to the carrier in a liquid or pasty state. By this state of the material during the application onto the carrier a simple handling will result, contributing to a high productivity of the method and to its economy.

A further embodiment provides that when using a single-constituent material, this material is processed in a single-constituent dosing device, and that when using a two-constituent material, the constituents of this material are processed and prepared in a multi-constituent dose and mixing device. The use of such a device renders the process according to the invention technically relatively simple and reliable and provides for an inexpensive and low hazard operation and therein for a correspondingly inexpensive application of the method. Selectively a dynamic, driven mixing device or a static mixer can be used for the mixing operation.

Furthermore, the process provides that the material for forming the elastomer layer is applied onto the surface area of the carrier in a rotational casting process. The rotational casting process for applying the elastomer layer onto the carrier is particularly advantageous because it requires no molds and therefore enables the production of a seamless form with simple means. Rotational casting processes are known to the expert, e.g., in the coating technique.

In order to generate a reproducible layer thickness, as uniform as possible, when casting the material forming the elastomer layer onto the surface area of the carrier, it is preferably provided that the casting is attained in form of a caterpillar like material string describing a helix. The helix form may be attained in a simple way by rotating the carrier about its longitudinal center axis, and by displacing the carrier and the device or unit outputting the material string, in relation to each other, in longitudinal direction of the carrier. In this case, for applying the method, simple devices and driving means may be used which are to be manufactured and operated with low cost. Because of the liquid or pasty state of the material string which are described further above, and the rotation of the carrier, the adjacent parts of the string will flow into each other and form a layer of a relatively uniform layer thickness.

Alternately to the rotational casting process, the material for forming the elastomer layer is to be applied onto the surface area of the carrier in a mold casting process. The mold casting process requires the production and application of a mold, however, the mold casting process also offers the advantage that the surfaces of the elastomer layer after the casting process comprise a greater accuracy regarding the cylindrical outer circumference form in relation to the rotational casting process.

Furthermore, it is preferably provided that heat is applied to the material for forming the elastomer layer, during its application, and/or after its application onto the surface area of the carrier, and that by the application of heat, an interlacing of the material is started. In this way it is ensured that the material at the carrier will firstly form a relatively uniform layer, and that only thereafter the intercuring will start; thereby boundary surfaces within the elastomer layer are safely avoided. At the same time, a fast curing of the material to result in an elastomer layer is ensured, enabling a high productivity of the method and therein a high economy.

Preferably the heat is applied to the material by heat radiation without a contact. Thus, damages to the applied material layer are avoided. Furthermore, in this way simple devices for the application of heat can be used, e.g., electrically powered heat radiators. The heat source for the application of heat to the material selectively may be a part of the device for applying the material to the carrier, or may be a separate device into which the carrier, completely covered with the material, is transferred when the coating is finalized.

When carriers are used which are particularly heat sensitive, it is proposed that during the heat application to the material for forming, the elastomer layer the carrier is cooled. With carriers having a hollow interior the cooling is possible by passing a cooling medium, e.g., cooling air or water through the carrier; with solid carriers for cooling them, e.g., specially provided cooling medium passages may be provided in order to enable the required cooling.

It has found to be advantageous for gaining optimal printing, transfer or imprinting qualities and tool lives of the form, to generate the elastomer layer with a thickness of between about 1 and 5 mm. Thereby the elastomer layer is advantageously thin, resulting in a low consumption of material and contributing to low manufacturing cost for the forms. Furthermore, the relatively small thickness of the elastomer layer minimizes the flexing work of the elastomer layer during operation, substantially contributing to long tool lives of the forms. At the same time, an exact geometry, in particular an exact diameter and a precise concentric running, is essential for a good printing, transfer or imprinting quality. In order to guarantee this accuracy, it is provided that the elastomer layer after the curing thereof is machined by grinding to result in a cylindrical outer circumference shape.

In order to reduce the amount per form of the relatively expensive elastomer layer materials, and in order to influence the features, in particular the hardness and the resilience of the elastomer layer, it is provided that at least one filler is added to the material for forming the elastomer layer prior to applying it onto the carrier. By varying the volume ratio between the material as such at the one side, and the filler or the fillers at the other side, the mechanical and chemical features of the elastomer layer may be influenced in the required way over a wide range.

At least one mineral is preferably used as the filler, as minerals at the one side are relatively inexpensive, and at the other side, either by reaction with the material silicone polymer or its components, positively influence the features of the final elastomer layer or are chemically inert versus the material silicone polymer. Minerals suitable for the use in the process according to the invention because of their chemical and physical features are, e.g., quartz powder, silicic acid, calcium carbonate, French chalk, mica or aluminum hydroxide.

In case a form with a particularly low weight must be produced which is easy to handle and in particular inexpensive to transport, preferably a sleeve of plastic material is used as the carrier. The use of sleeves as carriers for printing forms is known as such, however, it was hitherto only used in the area of rotogravure or offset printing forms or block sleeves with bent and bonded block plates. The sleeves at the inner circumference thereof may be selectively cylindrical or slightly conical as is known as such; the outer circumference of the finished form in any case has to be cylindrical.

In case a plastic material sleeve is used as the carrier, this is preferably produced with a single or several layers of elastomer and/or duroplastic materials in the form of foams and/or casting compounds. Therein these materials may be sensitive to temperatures as long as the form is not used as an imprinting form for imprinting hot materials like thermoplastic foils, because a vulcanization for the application of the outer elastomer layer as a printing or transferring or imprinting surface is not required; the carrier has only to withstand the relatively short term heat application for the hot curing of the elastomer layer.

Materials, in particular in the form of foams, have a low density and therefore enable the production of sleeves with relatively large wall thicknesses without their weight being intolerably high. In this way the outer circumference of the forms may be varied over a large range, whereby correspondingly large repeat length areas may be covered. The user of the forms has only to keep a relatively low number of mandrel rollers in stock onto which the sleeve-like forms have to be attached for the printing or transfer or imprinting operation.

When forms have to be supplied to users which have metal sleeves and the users want to use them further, the carrier preferably is a hollow cylindrical sleeve of metal wherein the metal preferably is nickel. Metal sleeves are advantageously multi-useable wherein they repeatedly are re-processed, i.e., recoated. Furthermore, a compound construction of the carrier of plastic material and metal is possible.

In case a low weight of the forms is of no interest, or if the user of the forms is not technically equipped for the use of sleeve forms, also a metal cylinder may be used as the carrier, e.g., of aluminum or steel.

The engraving of the cured elastomer layer preferably is attained by laser engraving because this engraving method may be accomplished particularly fast and inexpensive, and because it may be accomplished under control of digitally stored data. Tests have shown that the surface of the elastomer layer of the forms according to the invention may be engraved by laser beams. Thus, the forms produced in the process mentioned fulfill particularly well the requirements for simple and fast engraving. By a suitable selection of the degree of interlacing of the materials, and of the kind and volume of the fillers eventually used, the laser engraveability of the elastomer layer may be set and optimized in the required way. In the ideal case, the elastomer layer is directly evaporated and/or incinerated in a point without significant melting of the adjacent areas when it is hit by a focussed laser beam.

After all, it may be stated that the method according to the invention with its embodiments enables the production of forms for the rotary printing, coating or imprinting of web-shaped materials fulfilling all practical requirements, wherein the process may be accomplished with low technical effort and at low cost, and offers a freedom hitherto unknown regarding the selection of materials for the carrier and the geometric design thereof. In the following, an example for a material composition is described which is suitable for forming an elastomer layer. The following per cent numbers always are weight percent.

EXAMPLE

| Two-constituent-Silicone polymer material | |
|---|---|
| Constituent A: | |
| Polysiloxane containing vinyl groups | 40–90% |
| Amorphous silicid acid | 0.2–10% |
| Filler | 0–70% |
| Platinum catalyst | 0.01–3% |
| Multifunctional vinyl composition | 0.2–4% |
| Ethine-restrainer | 0–5% |
| Zeolithe | 0.5–10 |

-continued

| Two-constituent-Silicone polymer material | |
|---|---|
| Constituent B: | |
| Multifunctional hydrosilicone compounds | 2–20% |

The constituent A as well as the constituent B of this material, according to the aforementioned example, are to be stored over many months when they are separated. When the constituent A and the constituent B for forming the material for generating the elastomer layer are first mixed, no or practically no reaction of the constituents will take place, i.e., there is no curing or interlacing. Only by a heating to above approximately 80° C. will the interlacing start, in case there is no or only little ethine-restrainer used, such that only then the curing of the material will start. By an increase of the percentage of the ethine-restrainer, the interlacing start temperature is raised.

In the formula according to the example a single-constituent silicone polymer material may also be produced by mixing the constituents A and B which, however, is to be stored only for a relatively short time, i.e., some weeks. Also, with a single-constituent material, an inter-lacing and therefore a curing of the material will only start after heating it up to approximately 80° C. if no, or only a small amount of. ethine-restrainer is used. A higher percentage of ethine-restrainer in this case will also raise the interlacing start temperature.

The usual temperature for interlacing and curing the silicone polymer materials according to the examples is approximately 180° C., however, a curing is also possible in a temperature range extending from approximately 80° C. to maximal approximately 250° C. The time span wherein this temperature has to prevail within the materials is relatively short, in practical experience this time span is no longer than approximately 30 minutes even with large forms. If a faster curing is required, this is possible by raising the temperature; in the reverse case, with lower temperature, a longer curing time has to be tolerated.

Other objects and advantages of the present invention will become apparent upon reading the following detailed description and appended claims, and upon reference to the accompanying drawings.

In the drawing a device is described with the help of which forms according to the invention may be produced. In the drawings:

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
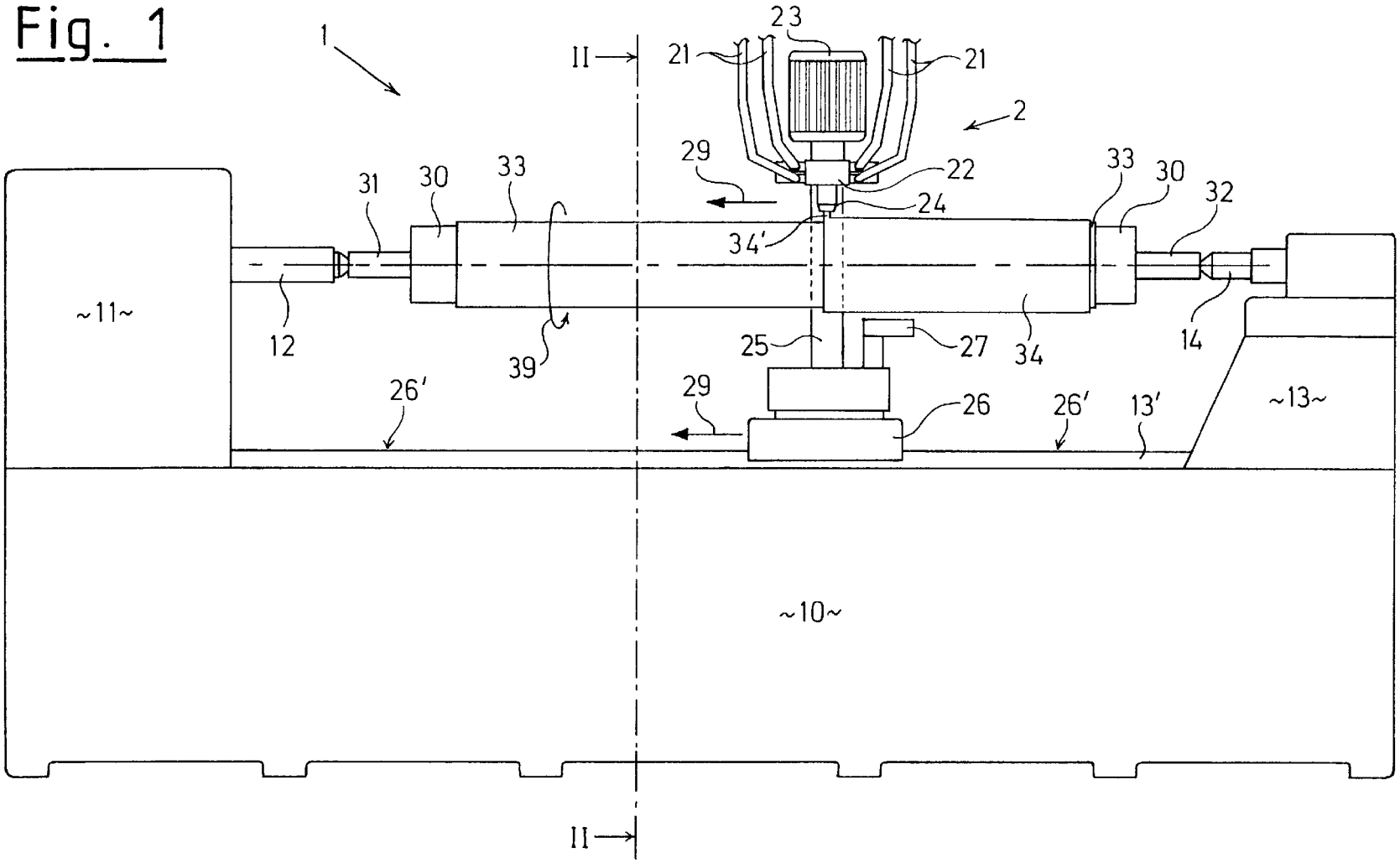
FIG. 1 illustrates a device for the production of forms in a simplified front view.

According to FIG. 1, the device 1 consists of a machine base 10 whereupon, like at a lathe, at the left end a spindle head 11 and at the right end a tailstock 13 are positioned. The spindle head 11 is secured at the machine base 10; a rotatable spindle 12 projects out of the spindle head 11 to the right side. The tailstock 13 at the opposite front end of the machine base 10 is displaceable in longitudinal direction of the machine base 10 in a sliding guide 13', and securable in required positions. An idling point 14 is rotatably supported at the tailstock 13 in alignment with the spindle 12.

Between the spindle 12 and the idling point 14, a mandrel roller 30 is supported by means of its axle stubs 31, 32, such that when the spindle 12 is rotated, the mandrel roller 30 is also rotating about its longitudinal center axis as indicated by the rotating arrow 39.

A sleeve 33 is arranged at the mandrel roller 30 with the sleeve, 33 e.g., pushed onto the mandrel roller 30 by a pressurized medium, and is removed therefrom in the same way.

Furthermore, the device 1 comprises an application device 2 which is secured at a support frame 25. The support frame 25, at the lower end-thereof is secured at a longitudinal slide 26 which is movable along a sliding guide 26' (not visible) in parallel with the sliding guide 13' in longitudinal direction of the machine base 10. At the upper end of the supporting frame 25, a mixing head 22 is secured as a part of the application device, which mixing head comprises a dynamic mixing element with an electrically driven drive unit 23. Several pipes 21 are guided to the mixing head 22. In the present example, two feeding pipes and two recirculation pipes, through which the constituents of an elastomer material are transported from reservoirs through at least partially elastic resilient pipe areas to the mixing head 22, and when required, in particular when the extrusion is discontinued, are reversed. In the mixing head 22 the elastomer material is processed and mixed and subsequently extruded through a nozzle 24 arranged below the mixing head 22 in the form of a material string 34' onto the outer circumference of the sleeve 33. The application is attained in the form of a helix, wherein the mandrel roller 30 together with the sleeve 33 rotates in the direction of the rotating arrow 39, and wherein the application device 2 is moved in the direction of the arrow 29 by means of the longitudinal slide 26. The turning speed of the mandrel roller 30 with the sleeve 33, and the feeding speed of the longitudinal support 26, are correlated with each other such that the single turns of the material string 34' are put directly next to each other, such that a homogenous coating 34 is attained at the complete surface of the sleeve 33 before a curing or interlacing starts. In FIG. 1 the right part of the sleeve 33 has already been provided with the coating 34, this coating process is continued as described before until the left end area of the sleeve 33 is reached.

Finally, the device 1 also comprises a heat radiator 27 connected to the support frame 25 with the heat radiator arranged below the already coated parts of the sleeve 33, and moving in the direction of the arrow 29 together with the longitudinal slide 26. The heat radiator 27 shines its heat radiation onto the surface of the coating 34, whereby this coating is heated. As soon as the coating 34 has reached a preselected temperature, e.g. 100° C., or exceeds it, a curing or interlacing is started in this coating 34. As it is obvious in FIG. 1, the heat radiator 27 follows the nozzle 24 in axial direction of the sleeve 33 such that there is sufficient time for the coating 34 to form a uniform layer after the discharge from the nozzle 24 onto the sleeve 33 before the heating starts.

Figure 2:
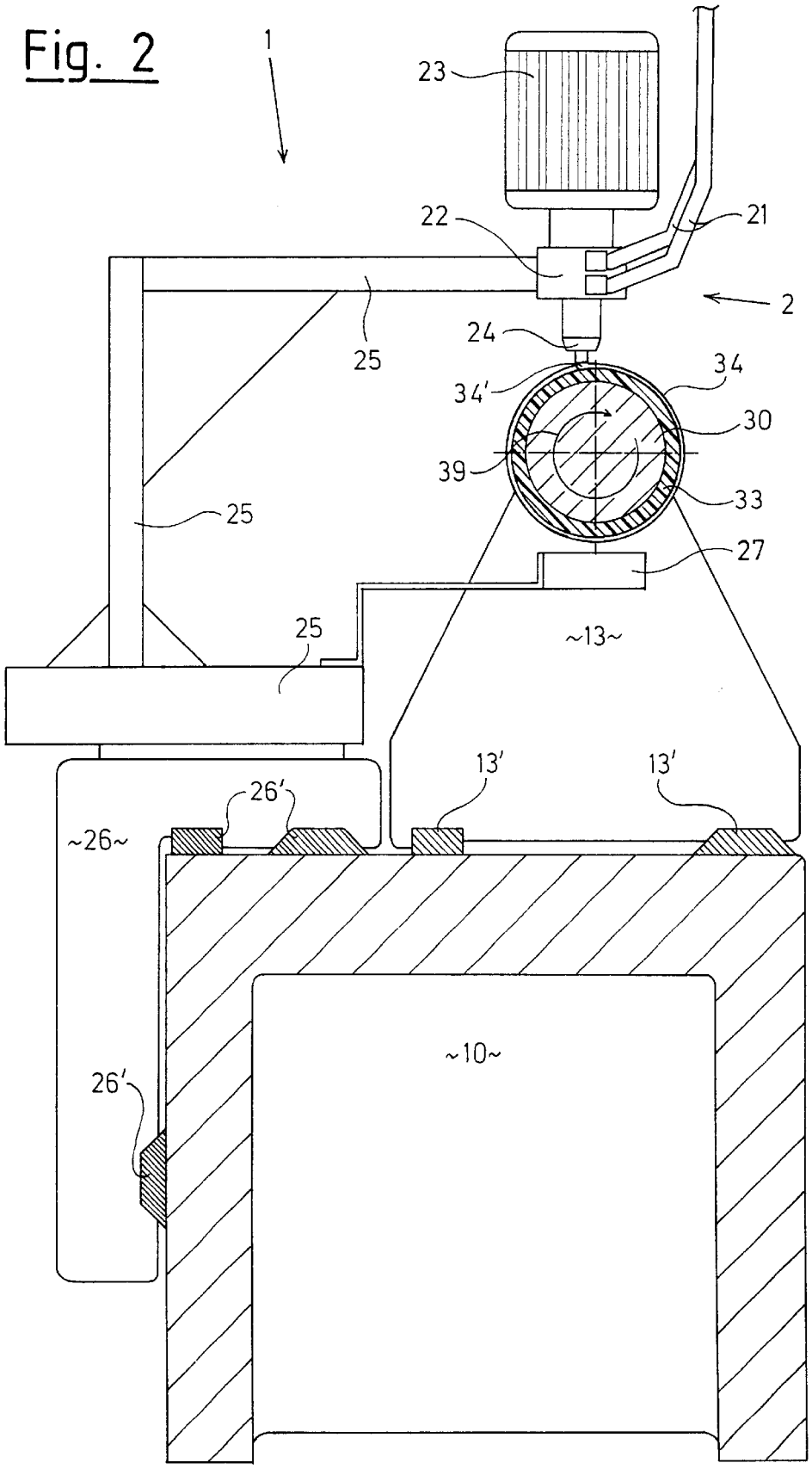
FIG. 2 illustrates the device of FIG. 1 in a cross-section taken along the line II—II in FIG. 1.

FIG. 2, in the lower-part thereof, illustrates in a cross-section the machine base 10. At the front part of its upper side, which is on the right side of the drawing, the machine base 10 carries the sliding guide 13' for the tailstock 13 which is visible in the background. In the rear of the machine base 10, which is on the left in the drawing, the sliding guide 26' for the longitudinal slide 26 is positioned, wherein the sliding guide 26' in this case is formed of three guiding rails in total. The support frame 25 is fastened at the upper side of the longitudinal slide 26, with the support frame extending like a gallows upwards and thereupon to the front, which is at the right part of the drawing. At the free upper end of the support frame 25 the application device 2 is fastened. The connection between the application device 2 and the support frame 25 is attained at the mixing head 22. The feeding pipes 21 open into the mixing head 22, however, only two of the feeding pipes are visible here. Above the mixing head 22 the drive unit 23 thereof is visible in the form of an electric motor.

The nozzle 24 projects downwards from the mixing head 22 with the material string 34' for generating the elastomer layer 34 extruding downwards from the nozzle 24. The nozzle 24 is positioned a small distance from the outer circumference surface of the sleeve 33 which is arranged at the mandrel roller 30. As it is illustrated in FIG. 2, the mandrel roller 30 consists of metal, preferably steel, whereas the sleeve 33 consists of plastic material and therefore has only little weight. The turning direction of the mandrel roller 30 with the sleeve 33 during the application of the elastomer layer 34 is indicated by the turning arrow 39. Below the mandrel roller 30, with the sleeve 33 and the elastomer layer 34, the heat radiator 27 is visible which is connected to the support frame 25 by an unnumbered bracket.

After finishing the coating 34, the sleeve 33 together with the associated mandrel roller 30 or separated therefrom, may be directly transferred for further machining, in particular grinding or engraving the elastomer layer 34.

From the above description, it is apparent that the objects of the present invention have been achieved. While only certain embodiments have been set forth, alternative embodiments and various modifications will be apparent from the above description to those skilled in the art. These and other alternatives are considered equivalents and within the scope of the present invention.

What is claimed is:

1. A method of manufacturing and using a form for flexographic printing, the method comprising the following steps:

providing a carrier having a cylindrical outer surface;

coating the cylindrical outer surface of the carrier with an elastomer layer comprising a hot cure material, the hot cure material being at least one of a one-component and a two-component silicone polymer;

applying heat to the elastomer layer;

curing the outer surface of the elastomer layer through said application of heat;

machining the outer surface of the elastomer layer;

engraving the outer surface of the elastomer layer; and using the resulting form in a flexographic printing process.

2. The method of claim 1 wherein the machining step provides the elastomer layer with a cylindrical shape.

3. The method of claim 1 wherein the coating step further comprises coating the cylindrical outer surface of the carrier with an elastomer layer comprising a hot cure material when the elastomer is in a liquid state.

4. The method of claim 1 wherein the elastomer is a one-component silicone polymer and the coating step is carried out with a single-constituent dosing device.

5. The method of claim 1 wherein the elastomer is a two-component silicone polymer, and the coating step is carried out with a multiple-constituent dosing device.

6. The method of claim 1 wherein the coating step is carried out by rotating the carrier and depositing liquid elastomer on the rotating carrier.

7. The method of claim 6 wherein the liquid elastomer is applied to the outer surface of the rotating carrier in a helical pattern.

8. The method of claim 1 wherein the coating step further comprises coating the cylindrical outer surface of the carrier with an elastomer layer by mold casting the elastomer onto the cylindrical outer surface of the carrier.

9. The method of claim 1 wherein the heat is applied to the elastomer layer as the elastomer is coated onto the carrier.

10. The method of claim 9 wherein the heat is radiated heat.

11. The method of claim 9 further comprising the step of cooling the carrier.

12. The method of claim 1 wherein the heat is applied to the elastomer layer after it has been coated onto the carrier.

13. The method of claim 12 wherein the heat is radiated heat.

14. The method of claim 12 further comprising the step of cooling the carrier.

15. The method of claim 1 wherein the machining step comprises grinding.

16. The method of claim 1 wherein the elastomer layer further comprises at least one filler.

17. The method of claim 16 wherein the filler comprises a mineral filler.

18. The method of claim 1 wherein the carrier comprises a sleeve of plastic material.

19. The method of claim 18 wherein the sleeve comprises a plurality of layers, at least one of the layers comprising a foam.

20. The method of claim 18 wherein the sleeve comprises a plurality of layers, at least one of layers comprising a casting compound.

21. The method of claim 1 wherein the carrier comprises a metal cylinder, the metal being selected from the group consisting of nickel, aluminum and steel.

22. The method of claim 1 wherein the engraving step comprises laser engraving.

23. The method of claim 1 further comprising rotating the carrier.

24. The method of claim 1, comprising the following additional steps:

rotating the carrier, coating the cylindrical outer surface of the carrier with a liquid elastomer material as the carrier is rotating.

25. The method of claim 24 wherein the elastomer material comprises in weight percent:

| | |
|---|---|
| polysiloxane containing vinyl groups | 40–90% |
| amorphous silicid acid | 0.2–10% |
| filler | 0–70% |
| platinum catalyst | 0.01–3% |
| multifunctional vinyl composition | 0.2–4% |
| ethine-restrainer | 0–5% |
| zeolite | 0.5–10% |
| multifunctional hydrosilicone compounds | 2–20%. |

26. A method of manufacturing and using a form for flexographic printing, the method comprising the following steps:

providing a carrier having a cylindrical outer surface;

coating the cylindrical outer surface of the carrier with an elastomer layer comprising a hot cure material when the elastomer is in a liquid state, the hot cure material being at least one of a one-component and a two-component silicone polymer;

applying heat to the elastomer layer as the elastomer layer is coated onto the carrier;

curing the outer surface of the elastomer layer through said application of heat;

machining the outer surface of the elastomer layer;

engraving the outer surface of the elastomer layer; and using the resulting form in a flexographic printing process.

27. A method of manufacturing and using a form for flexographic printing, the method comprising the following steps:

providing a carrier having a cylindrical outer surface;

coating the cylindrical outer surface of the carrier with an elastomer layer comprising a hot cure material when the elastomer is in a liquid state, the hot cure material at least one of a one-component and a two-component silicone polymer;

applying heat to the elastomer layer after the elastomer layer has been coated onto the carrier;

curing the outer surface of the elastomer layer through said application of heat;

machining the outer surface of the elastomer layer;

engraving the outer surface of the elastomer layer; and using the resulting form in a flexographic printing process.

* * * * *